US005215444A

United States Patent [19]

Bishoff

[11] Patent Number: 5,215,444

[45] Date of Patent: Jun. 1, 1993

[54] SYSTEM FOR CONTROLLING OIL VISCOSITY AND CLEANLINESS

[75] Inventor: David R. Bishoff, Stevens Point, Wis.

[73] Assignee: Woodward Governor Company, Stevens Point, Wis.

[21] Appl. No.: 892,559

[22] Filed: Jun. 2, 1992

Related U.S. Application Data

[63] Continuation-in-part of Ser. No. 602,712, Oct. 24, 1990, Pat. No. 5,118,259.

[51] Int. Cl.[5] ..... F04B 49/00

[52] U.S. Cl. ..... 417/281; 60/329; 137/115; 417/299; 417/307

[58] Field of Search ..... 417/307, 279, 281, 299; 137/115; 60/453, 329, 468

[56] References Cited

U.S. PATENT DOCUMENTS

| | | | |
|---|---|---|---|
| 2,467,509 | 4/1949 | Trautman | 60/329 |
| 2,635,620 | 4/1953 | Deardorff | 417/279 |
| 3,429,123 | 2/1969 | Burroughs | 60/453 |
| 3,871,266 | 3/1975 | Schwab | 60/329 X |
| 3,962,872 | 6/1976 | Budzich | 60/453 |
| 4,373,869 | 2/1983 | Martin | 60/468 X |

*Primary Examiner*—Leonard E. Smith
*Attorney, Agent, or Firm*—Leydig, Voit & Mayer

[57] ABSTRACT

A system for and a method of establishing and maintaining fluid at desired cleanliness, viscosity and temperature levels in a flow system. The system includes a driven pump that circulates fluid from a fluid source through a hydraulic loading system that includes an unloading valve. As fluid flows through the valve, a pressure drop is created across the valve operator, which restricts flow through the valve. This pressure drop across the valve operator results in the dissipation of heat, increasing the temperature of the fluid flowing through the valve. During operation of the system, if a low temperature condition is sensed in the system, power will be supplied to the pump, which pumps fluid through the valve at a controlled low pressure drop to result in a controlled heating of the fluid. When the fluid is restored to a desired temperature level, power to the pump is discontinued to terminate flow through the valve. The level of heat produced in the fluid may be adjusted by adjusting the degree that the pressure drops as the fluid flows through the valve. This is accomplished by adjusting the degree of the restriction to flow across the valve operator. Additionally, as fluid is circulated through the valve, at least a portion of the fluid is provided to a filter to provide a desired cleanliness level to the fluid.

26 Claims, 8 Drawing Sheets

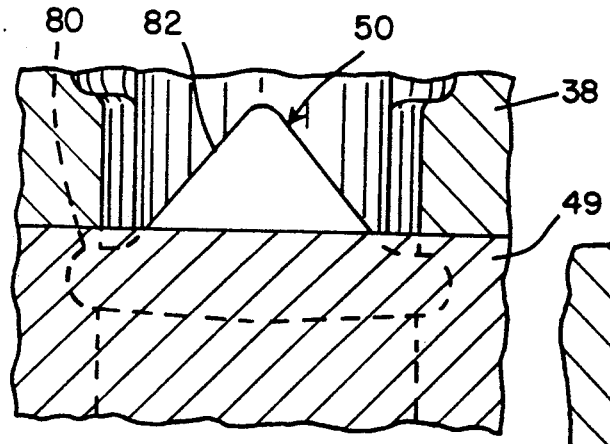
FIG. 7
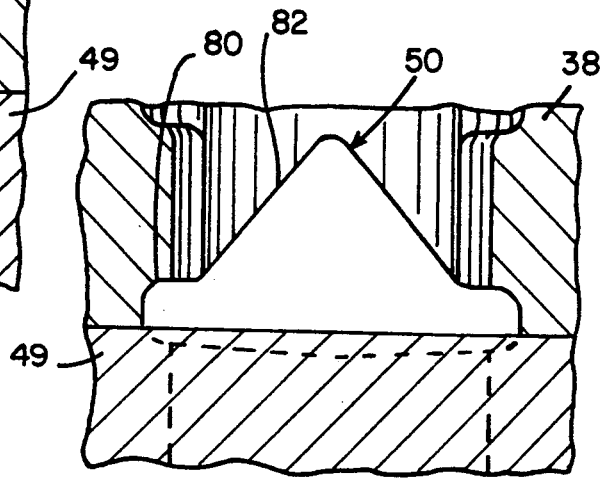
FIG. 8
| FLOW RELATED SETTING | | | |
|---|---|---|---|
| FLOW GPM | WASHER ON TOP | WASHER ON BOTTOM | GAP |
| 10 | 10 | 0 | 2.413 |
| 20 | 10 | 0 | 2.300 |
| 30 | 10 | 0 | 2.212 |
| 40 | 10 | 0 | 2.136 |
| 50 | 0 | 10 | 2.001 |
| 60 | 1 | 9 | 1.934 |
| 70 | 2 | 8 | 1.872 |
| 80 | 2 | 8 | 1.814 |
| 90 | 3 | 7 | 1.760 |
| 100 | 3 | 7 | 1.706 |
| 120 | 4 | 6 | 1.611 |
| 140 | 5 | 5 | 1.523 |
| 160 | 6 | 4 | 1.460 |
| 180 | 7 | 3 | 1.365 |
| 200 | 8 | 2 | 1.221 |
FIG. 9

SYSTEM FOR CONTROLLING OIL VISCOSITY AND CLEANLINESS

This application is a continuation-in-part application of U.S. Ser. No. 602,712, filed Oct. 24, 1990, now U.S. Pat. No. 5,118,259. The invention relates generally to hydraulic systems, and more specifically to flow control valves.

FIELD OF THE INVENTION

BACKGROUND OF THE INVENTION

Fluid cleanliness and viscosity are probably the two most important properties of hydraulic fluid in a fluid power system. Contaminants may be supplied to the hydraulic system from sources both internal and external to the system. The level of undesirable contaminants in the hydraulic fluid affects the quality of system performance, as well as the useful life of substantially all of the working hydraulic components within a hydraulic system. All moving components in contact with the fluid are vulnerable to wear, and attendant premature failure if such contaminants are not removed from the system. Consequently, the proper cleaning of the fluid to remove undesirable contaminants can significantly lengthen the life of the system components, as well as reducing maintenance and its attendant costs. Further, effective cleanliness control can result in significant improvements in the overall reliability and performance of the system.

A number of methods have been utilized to control the cleanliness of the fluid in hydraulic systems. The filters utilized in typical cleanliness control systems must withstand high pressure and/or high volume flow in certain applications. Consequently, such filter arrangements are often expensive and can contribute to related system problems.

For example, a filter may be interposed in line before the load to provide full flow filtering. This method is effective in many types of systems having relatively low fluid flow, e.g., 30 gpm or less. However, many hydraulic systems provide relatively large flows at high pressures, often running on the order of 400 gpm at pressures of 1000 psi or greater. Interposing a filter in line before the load is often impractical in those high pressure systems with relatively large fluid flows. Further, maintaining filters in such an environment is generally quite expensive.

Alternately, full flow filtering may be provided after fluid has serviced the load. In this method of filtering, a filter is typically interposed in the return line between the load and the sump. Although less costly than filtering systems having the filter disposed before the load, return oil filtering can still be quite costly. Additionally, as return line filters become dirty, they develop back pressure. The development of back pressure can be a problem in that a number of valving systems do not perform properly with the application of back pressure.

An additional method of filtering disposes a filter in the sump. By nature, these filters are coarse so as not to affect flow of fluid to the pump. Consequently, while this method may be effective for filtering large particles, small particles are not effectively blocked.

Viscosity is a measure of the resistance of the fluid to flow, or, in other words, the sluggishness with which the fluid moves. When the viscosity is low, the fluid is thin and has a low body; consequently, the fluid flows easily. Conversely, when the viscosity is high, the fluid is thick in appearance and has a high body; thus, the fluid flows with difficulty.

Maintaining the hydraulic fluid at the ideal viscosity for a given hydraulic system is an important feature of ensuring efficient operation of the system. If the viscosity of the fluid is too high, the system will operate sluggishly and consume greater amounts of power due to this higher resistance to flow. A higher viscosity also tends to inhibit the proper release of entrapped air from the oil. This entrapped air, which causes the oil to appear foamy, tends to reduce the bulk modulus of the oil so that the oil behaves in a "spongy" manner. Utilization of oil having a lower bulk modulus (high air entrainment) also increases the noise levels of the pump and valves, and decreases the stability of the operation valves and servo control systems. In addition, oil having trapped air can cause premature damage to pumps as a result of cavitation and microscopic burning of the oil as the air bubbles pass from the inlet to the outlet of the pump.

Additionally, high fluid viscosity will result in increased pressure drop through valves and lines. Conversely, too low of a fluid viscosity will result in increased leakage losses past the seals, and excessive wear due to the breakdown of the oil film between moving parts.

Hydraulic fluid, such as oil, becomes thicker, or more viscous, ,as the temperature decreases, and thinner, or less viscous, when heated. Thus, changes in temperature can have a significant effect on viscosity, and, therefore, efficient operation of the components of the hydraulic system. Further, excessive temperature hastens oxidation of hydraulic oil and causes it to become too thin. This promotes deterioration of seals and packings, and likewise accelerates wear between closely fitting parts of hydraulic components of valves, pumps, and actuators. Conversely, when the fluid is at an optimum temperature, it will exhibit enhanced air release and display a desirable increased fluid bulk modulus. The high fluid bulk modulus, or, in other words, the incompressibility of the fluid at the optimum temperature provides the highly favorable stiffness of hydraulic systems that makes them the frequent choice for many high-power applications.

Changes in the temperature that affect the operation of the hydraulic system may be caused by environmental conditions, or by heat generated in the system itself. For example, fixed displacement pumping systems are commonly used in hydroturbine governing systems, which are typically located inside powerhouses and, therefore, are considered at least partially protected from environmental elements. Despite this sheltered condition, however, the temperature within powerhouses may vary on the order of 50°-110° F.

Significant sources of heat in the hydraulic loading system include the pump, pressure relief valves, and flow control valves. The operation of the hydraulic system, whether the loading system is operating in a continuous or cyclic mode, may result in undesirable fluid temperature and viscosity characteristics. When the pump is operating in a continuous mode, the constant circulation of fluid, even at low flow rates, may result in an undesirable increase in fluid temperature, or over-temperature condition, and a corresponding decrease in fluid viscosity. Further, when the fluid is stagnant, as between cycles when the pump is operating in the cyclic mode, the fluid may fall below the optimum temperature level, with a corresponding increase in viscosity. Therefore, when the demands of equipment connected to the pump are light, the viscosity will be high, whereas increased usage of the same system results in decreased viscosity.

A common method of maintaining a desired steady-state temperature and, therefore, viscosity of the hydraulic fluid is to use heat exchangers. Heat exchangers are generally in the form of coolers or heaters that may be interposed in the system to increase the heat dissipation rate or the heat generation rate, respectively. Systems using such heat exchangers have a number of disadvantages. Local oil heaters, which usually employ electrical heating elements, tend to be fairly heat intensive and may tend to burn oil. Cooling is generally accomplished with water to oil heat exchangers. If water from this type of cooler leaks into the oil, major problems may result in the hydraulic system.

Further, such heat exchanges are additional components that are generally associated with a dedicated heating or cooling system. As a result, the use of heat exchangers adds to the overall cost and complexity of the hydraulic system, requiring additional hardware, controls, and operator time to monitor, control, and maintain the equipment. Because the use of heat exchangers may be dictated by the environment in which a system will operate, systems are often designed for use in specific applications. For example, heaters rather than coolers are typical in mobile hydraulic equipment that is required to operate in sub-zero temperatures, whereas coolers may be required in a system that operates continuously in a warm environment. Alternately, a hydraulic system that operates intermittently or more heavily at times may require multiple heat exchangers. For example, at times when the system operates infrequently, as when the demands by the connected system are light, the viscosity will be high, consequently requiring heaters to reduce the viscosity to an appropriate level. Conversely, when the demands of the connected system are heavy, the hydraulic system may be used more often, or even continuously, resulting in lower viscosity fluid. In this way, the same system may require coolers to increase the viscosity of the fluid. Thus, the use of heat exchangers contributes to the overall cost, complexity, and physical size of a hydraulic system.

OBJECTS OF THE INVENTION

It is a primary object of the invention to provide a hydraulic system having effective and efficient cleanliness control. Related objects are to eliminate the need for independent cleanliness control systems and to provide a hydraulic system having relatively low cost cleanliness control.

Another object is to provide a cleanliness control system in combination with an economical, reliable, uncomplicated hydraulic system which maintains the hydraulic fluid at the ideal temperature and viscosity levels to provide efficient operation of the hydraulic components of the system. A related object is to eliminate the need for auxiliary heat exchangers and heat exchange systems to control the temperature and viscosity of the hydraulic fluid.

Other objects are to provide a system having enhanced system performance, reduced levels of entrapped air in the fluid, and minimal leakage losses past seals. Yet another object is to provide a system which exhibits minimal deterioration and wear of hydraulic components of the system.

A further object is to provide a system that evenly heats the fluid and may be adjusted to provide a desired level of heat output. A related object is to provide a hydraulic system that can be used in many different environmental locations.

SUMMARY OF THE INVENTION

In accomplishing these objectives in accordance with the invention, there is provided a system for and a method of establishing and maintaining fluid at a desired cleanliness level in a flow system by utilizing a valve. The system includes a driven, preferably fixed displacement, pump that circulates fluid from a fluid supply through a hydraulic system having various components, including at least one valve and piping. The valve comprises a valve body having an inlet and an outlet, and a valve operator, which restricts flow through the body.

The hydraulic system is provided with a cleanliness control system. A filter is disposed within the system such that at least a portion of fluid flowing through the valve flows through the filter to provide effective cleanliness control. Flow through the filter may be channelled directly to the sump, or, preferably, back to the outlet line of the valve. Preferably, a long flow path is provided between the pump inlet and the sump return line to facilitate mixing.

The valve may be provided with a second orifice or restrictor, which may be of fixed size, disposed within the flow path through the valve. The restrictor provides a variation in pressure between the chamber before the restrictor and the sump return outlet. Placement of the filter in a parallel flow path with the restrictor results in a similar drop in flow pressure through the filter and associated flow coupling pipes. This pressure drop increases as the filter becomes dirty. Consequently, the pressure drop may be monitored to provide an indication of a low flow condition through the filter, and, therefore, an indication that the filter requires replacement.

Several distinct advantages are offered by this cleanliness control system. Even though the hydraulic system may have a high flow volume through the valve, only a portion of the flow is directed to the filter itself. Consequently, the cleanliness control system may utilize a filter designed for low pressure and low volume flows, rather than a generally more expensive filter designed for high pressure and/or high volume flow, such as is typically required for in-line filtering. As a result, the system may utilize a low cost, but very efficient, spin-on type filter, similar to an automobile spin-on filter, while providing effective cleaning of the hydraulic fluid.

According to an additional feature of the invention, there is provided a system for and a method of maintaining fluid at desired viscosity and temperature levels, which may utilize the same valve to which the cleanliness control system is coupled. The system includes a temperature sensor that is coupled to the pump. As fluid flows through the valve, the restriction to flow presented by the orifice or restrictor, and the operation of the valve operator results in a pressure differential across the valve operator, and, therefore, across the valve from the pump to the sump return. According to accepted fluid flow principles, as a result of the oil flow at this pressure drop across the valve, or, in other words, the increase in pressure along the inlet side of the valve, energy will be dissipated in the form of heat, which results in an increase in the temperature of the fluid flowing through the valve. Thus, operation of the system at a relatively low pressure differential (generally on the order of 20–100 psi), as when the valve is operating in an unloaded condition, results in a controlled increase in fluid temperature. During operation, when the temperature sensor senses that the fluid has reached the required temperature point to obtain a desired viscosity level, the pump is de-energized to terminate flow through the valve. The level of heat produced in the fluid may be adjusted by adjusting the degree that the pressure drops as it flows through the valve. This is accomplished by adjusting the degree of restriction to flow through the valve itself, which may be adjusted from a relatively low pressure drop (on the order of 5 psi, in a preferred embodiment), to a relatively high pressure drop (on the order of 100 psi, likewise in a preferred embodiment). As the flow restriction increases, the heat dissipation, and, therefore, the temperature of the fluid increases. This flow restriction may be adjusted such that the system heats the load to an ideal operating temperature (generally on the order of 100° F.) with the pump operating at a 50% duty cycle.

The cleanliness control system may be utilized with substantially any bypass valve of a given hydraulic system. In the preferred embodiment of the invention, the cleanliness control system is utilized in conjunction with the unloader valve of the viscosity control system. The high flow condition through the valve results in an effective, low cost method of both heating and cleaning the fluid. Further, the circulation of the hydraulic fluid through a long flow path results in desirable mixing effects which provide not only even heating of the oil, but improved filtering efficiency over many conventional designs.

Inasmuch as control of the fluid cleanliness, as well as fluid temperature and viscosity levels is dependent upon flow through the components of the system itself, this eliminates the need for auxiliary heat exchangers or an independent cleanliness control system. Furthermore, the fluid cleanliness, temperature, and viscosity control system may utilize a valve that performs one or more additional functions in the hydraulic system. This utilization of a multipurpose valve along with the system adjustability results in certain economies in both manufacture an stock keeping. Furthermore, the system and method of operating the system are reliable and uncomplicated. The utilization of fluid at ideal temperature and viscosity levels and having good cleanliness levels allows the components of the hydraulic system to operate efficiently with low levels of entrapped air, reduced power consumption, and minimal leakage losses past seals. This efficient and clean level of operation results in minimal deterioration and wear of the hydraulic components themselves, extending the life of the components and reducing maintenance costs and system downtime. Additionally, as the level of heat output may be readjusted, a single system may be utilized in many environmental locations.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 7 is a fragmentary view of the unloading valve taken along line 7—7 in FIG. 5, wherein the valve is set up for relatively low flow rates.

FIG. 8 is a fragmentary view of the unloading valve taken along line 8—8 in FIG. 5, wherein the valve is set up for relatively high flow rates.

FIG. 9 is a chart of flow related settings for set up of the unloading valve.

DETAILED DESCRIPTION OF THE PREFERRED EMBODIMENTS

While the invention will be described and disclosed in connection with certain preferred embodiments and procedures, it is not intended to limit the invention to those specific embodiments. Rather it is intended to cover all such alternative embodiments and modifications as fall within the spirit and scope of the invention as defined in the appended claims.

Figure 1:
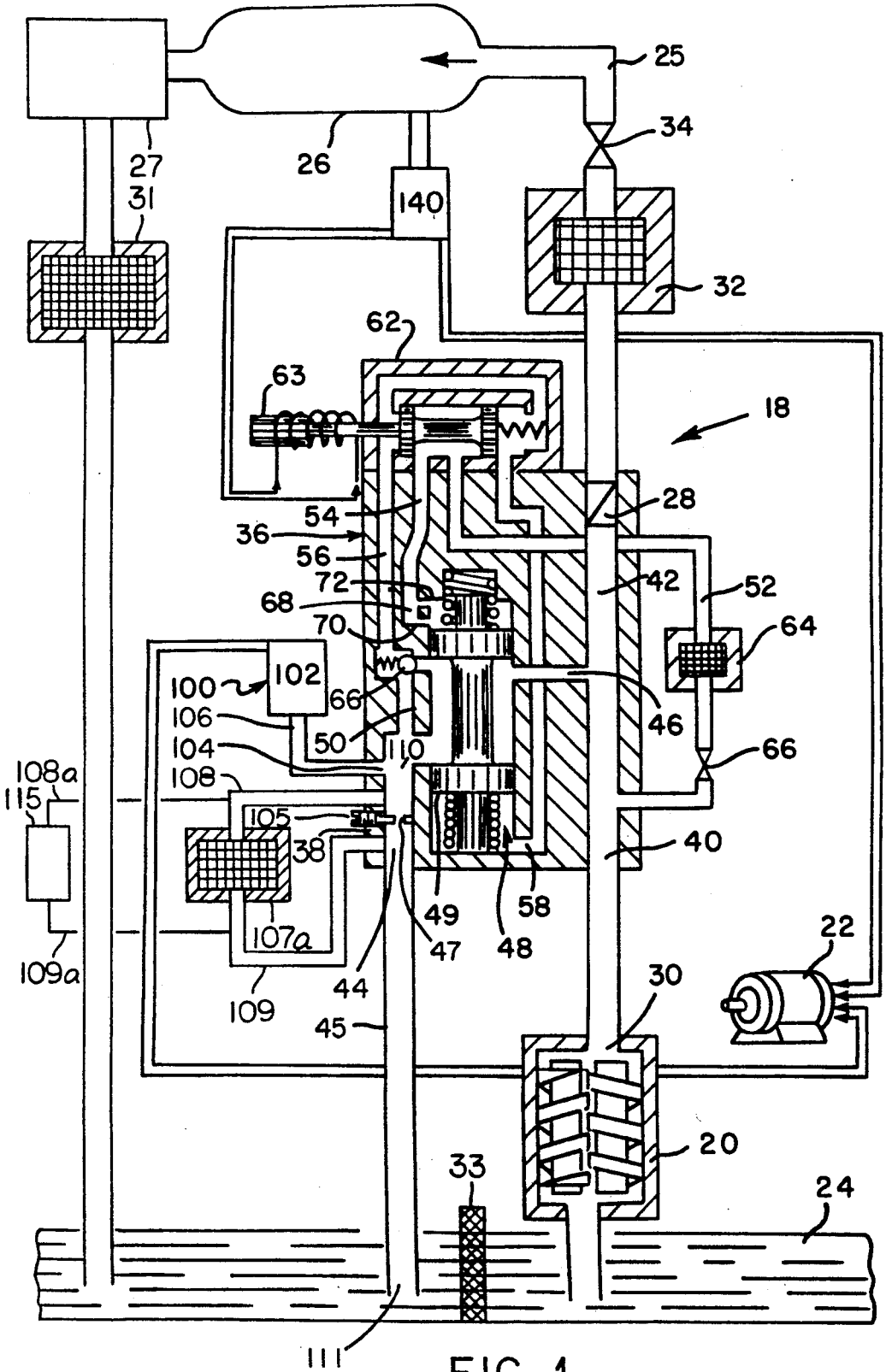
FIG. 1 is a schematic of the hydraulic fluid supply system in an unloaded position, with the directional control valve in the first position.

Turning now to the drawings, FIG. 1 shows a schematic of a hydraulic fluid supply system 18 exemplifying the present invention. It will be appreciated that the supply system 18 shown may be one of a number of such systems in a hydraulic fluid control system. It will further be appreciated that, while the invention is described in connection with a specific type of valve, more particularly, an unloading valve, it is equally applicable to alternate types of valves wherein a flow restriction within the valve results in a pressure drop across the valve, as explained below. An oil pump 20, which is usually powered by a motor 22, supplies high pressure hydraulic fluid from a fluid supply source, such as a sump 24, to a high pressure outlet 25. The outlet furnishes hydraulic fluid under pressure to an accumulator 26, and onto a load (shown generally as 27). A one-way check valve or spring-loaded poppet valve 28 interposed in the line between the pump 20 and the high pressure outlet 25 insures that fluid flowing from the pump outlet 30 reaches a desired pressure level before flowing to the high pressure load 26. A valve 34, which is in a normally open position when the particular supply system is in use, disposed between the one-way check valve 28 and the high pressure load 26 may be closed when the particular supply system 18 is not being utilized, as during maintenance.

One or more filters 31, 32, 33 may be utilized to remove from the hydraulic fluid impurities that would damage the hydraulic system or reduce its level of reliability and/or safety. For example, a filter 33 may be disposed within the sump 24. Alternately or additionally, a filter 31 may be interposed in the return line from the load 27. Alternately or additionally, a filter 32 may be interposed in the line between the sump 24 and the high pressure load 27 or the accumulator 26.

The system 18 preferably utilizes a fixed displacement pump 20 that comes up to speed in a finite time with fluid flow impelled by the pump 20 also increasing during that interval In many cases, it is desirable to limit the load on the pump 20 during this start up interval. In order to allow the pump 20 to come up to speed at a light load before the high pressure load 26 is placed on the system 18 or develop sufficient pressure to supply the high pressure load 26, an unloading valve 36 is interposed between the pump 20 and the load 26. While in this example, the one-way check valve 28 is an integral part of the valve 36, it is not necessarily a requirement of the invention. The valve 36 includes a valve body 38 having an inlet 40, a working outlet 42, and a bypass outlet 44. In the exemplified embodiment of the invention, an orifice or restrictor 47 is provided in the valve 18 at the bypass outlet 44 to restrict the return flow to the sump 24. It will be appreciated that the restrictor 47 is not a requirement of the invention, with the understanding, however, that the flow pipes are sized to provide the required back pressure at the filter to facilitate flow therethrough (as shown, for example, in FIG. 10, wherein the pipes 44, 45 are sized to provide a desired pressure drop).

Figure 3:
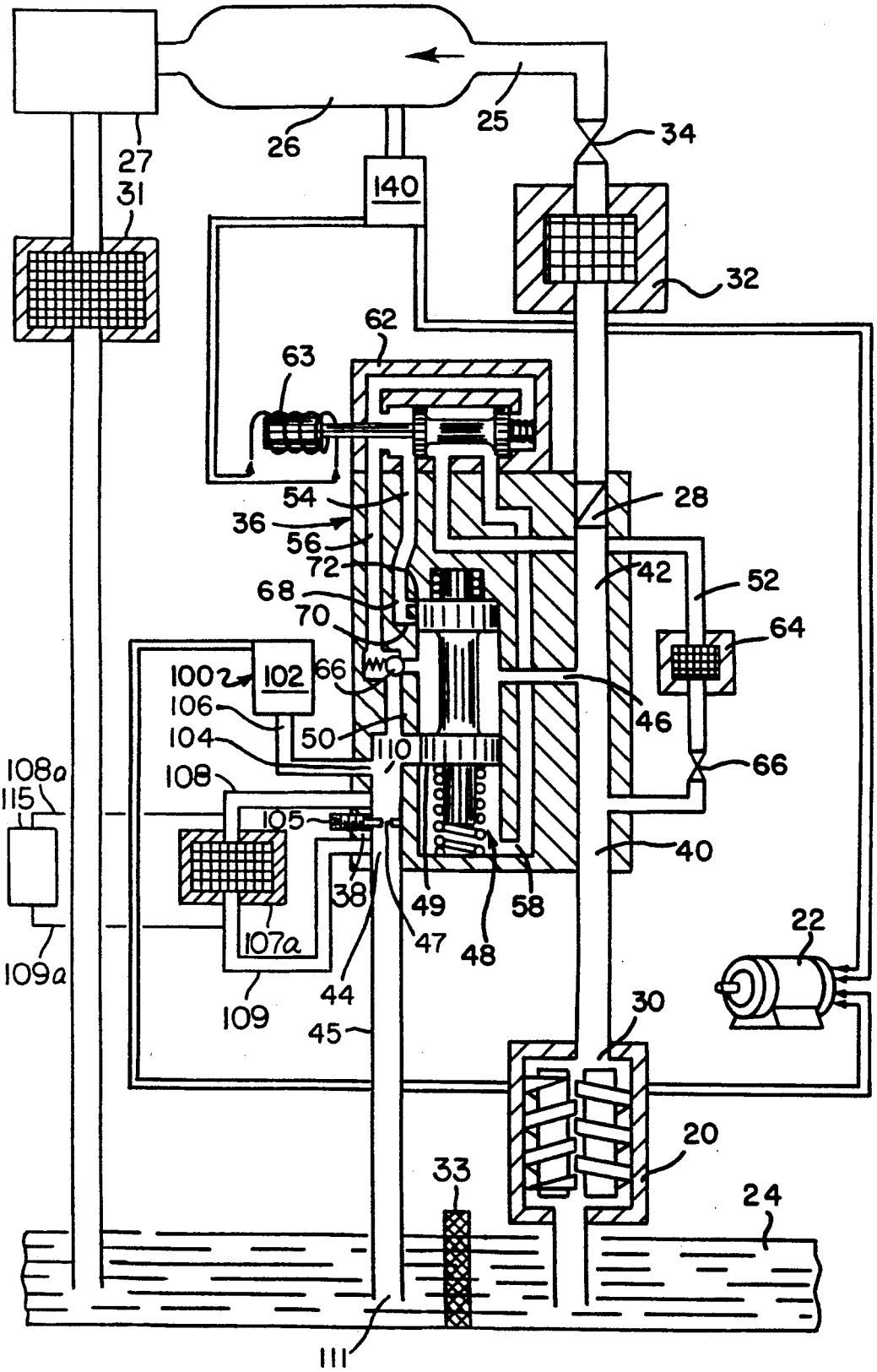
FIG. 3 is the schematic of the system of FIG. i in a loaded position with the directional control valve in the second position.
Figure 4:
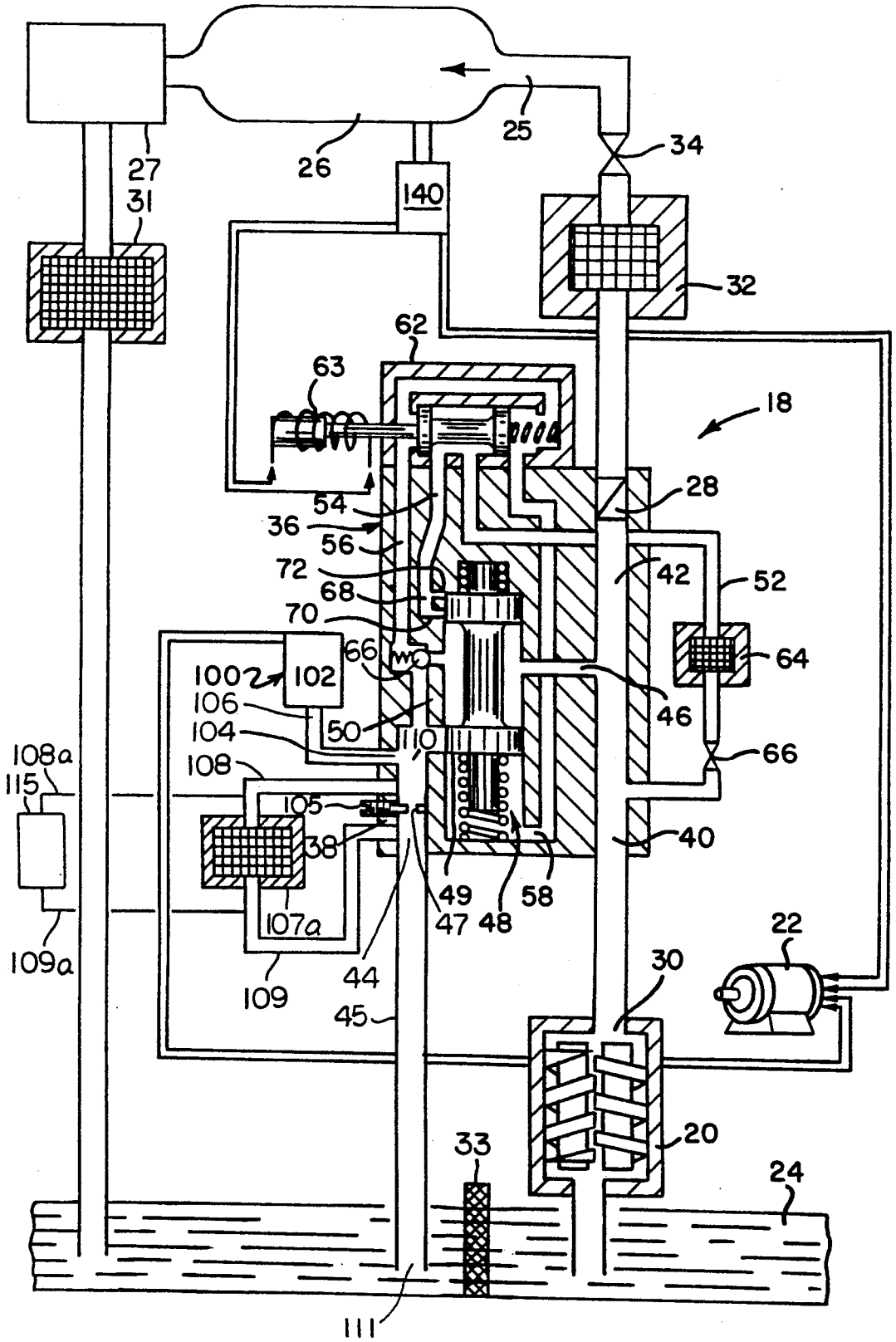
FIG. 4 is the schematic of the system of FIG. 1 in a loaded position with the directional control valve in the first position.

When the pump 20 is in an unloaded condition, fluid enters the valve 36 through the inlet 40 and exits through the bypass outlet 44 to return to the sump 24 via the return line 45. As shown in FIGS. i and 2, fluid from the inlet 40 flows through line 46, a valve operator (designated generally as 48), such as a piston type valve having a spool 49, and the bypass outlet 44 to the sump 24 via the return line 45. When the pump 20 has developed sufficient pressure, the spool 49 is caused to move axially to close off the bypass port 50 and prevent flow from exiting the valve 36 through the bypass outlet 44, as shown in FIGS. 3 and 4. As a result, flow entering the valve 36 is forced to exit through the working outlet 42 and the one-way check valve 28 to the high pressure outlet 25.

When normal fluid pressure of a desired minimum is re-established in the accumulator 26, or it otherwise is desirable to de-energize the motor 22 or unload the pump 20, the spool 49 is caused to slide axially in the opposite direction, moving the valve operator 48 from the loaded condition shown in FIGS. 3 and 4 to the unloaded position shown in FIGS. I and 2, once again allowing flow through the valve 36 via the bypass outlet 44 and the return line 45 to the sump 24. Once the pump 20 is fully unloaded, the pump 20 and motor 22 may be de-energized without shock to the system. Alternately, the pump 20 may continue to run to circulate the fluid through the unloader valve 36.

In accordance with the invention, a system for and a method of establishing and maintaining fluid at a desired cleanliness level in the flow system is provided wherein a driven pump circulates fluid from a fluid supply through a hydraulic system that includes at least one valve. The valve comprises an inlet, an outlet, and a valve operator, which directs fluid flow through the body. The preferred embodiment of the invention further includes an orifice or restrictor disposed along the outlet side of the valve. While the invention is described with reference to an unloading valve, it will be appreciated that an alternate type of valve having an inlet, an outlet, and a valve operator for controlling directional flow through the valve could alternately be utilized.

The system is provided with a filter disposed along the return side of the valve. In this way, at least a portion of the flow through the valve in bypass mode to the bypass outlet flows through the filter to provide a desired level of cleanliness to the system. The filter may be positioned such that the flow through the filter is channeled directly to the sump. Alternately, the flow through the filter may be directed back to the outlet side of the valve to be returned to the sump. Where a restrictor is provided along the outlet side of the valve, flow through the restrictor results in an attendant drop in pressure between the chamber before the orifice and the sump return outlet. Placement of the filter in a parallel flow path with the restrictor, with the outlet from the filter returning to the valve outlet, results in a similar drop in flow pressure across the filter and coupling pipes.

In accordance with another aspect of the invention, the valve utilized in the cleanliness control system may additionally or alternately be utilized in a system and method for establishing and maintaining fluid at desired viscosity and temperature levels. It will be appreciated that the temperature and viscosity control system may likewise be utilized in conjunction with an alternate type of valve having an inlet, an outlet, and a restrictive valve operator. As fluid flows through the valve, a pressure differential is created across the valve. In accordance with accepted fluid flow principles, this pressure differential results in the dissipation of energy, resulting in an increase in the temperature of the fluid flowing through the valve. This increase in fluid temperature results in a corresponding decrease in the viscosity of the fluid. According to an important aspect of the invention, the heat produced in the fluid may be adjusted by adjusting the degree to which the valve operator restricts flow through the valve and/or modification of size of the restrictor, if provided. Greater amounts of heat will be produced in the fluid as the pressure drop across the valve is increased due to increased flow restriction. To provide a desired viscosity level by providing a desired temperature range of the fluid, a temperature sensor, which is coupled to the pump, is disposed to sense the temperature of the fluid in the system. During operation, the valve is operated in a substantially unloaded condition to obtain a desired pressure drop, and, consequently, a controlled level of heat generation. When the temperature sensor senses that the fluid has reached the required temperature to obtain a desired viscosity level, the pump is de-energized to terminate flow through the valve Preferably, the period which the pump runs is adequate to provide the desired cleanliness level, as explained below.

Turning now to the drawings, the invention may be described with respect to an unloading valve 36, such as the one disclosed in the figures and described in greater detail in U.S. Pat. No. 5,156,717, issued Oct. 20, 1992. The system will be described first with respect to the temperature and viscosity control system, and second with respect to the cleanliness control system. It will be appreciated, however, that the systems may each be utilized either alone, or in conjunction with one another.

While the invention is described with respect to the illustrated unloading valve 36, it will be appreciated that the invention is equally applicable to any type of valve in which a controlled pressure drop may be obtained across the valve to result in a controlled increase in fluid temperature. In the unloading valve 36 illustrated, flow through the unloading valve 36 serves as the actuating force for operation of the valve operator 48. The force created due to the flow through the inlet 40 of the valve 36 to the bypass outlet 44 may be controllably applied across the valve operator 48 to move the valve operator 48 from an unloaded condition, as shown in FIGS. i and 2, to a loaded condition, as shown in FIGS. 3 and 4. Likewise, the force created due to the flow through the inlet 40 of the valve 36 to the working outlet 44 may be controllably applied across the valve operator 48 to move the valve operator 48 from a loaded condition, as shown in FIGS. 3 and 4, to an unloaded condition, as shown in FIGS. I and 2.

It will be appreciated that the operating force may also be described in terms of pressure created by the flow from the pump 20. All other forces being substantially equal, when this pressure, which is applied to one end of the valve operator 48, is greater than the pressure applied to the opposite end of the valve operator 48, the valve 36 will transfer from either the unloaded to the loaded condition, or the loaded to the unloaded condition. While the invention may be described in terms of pressure, it will be appreciated that the invention could likewise be described in terms of forces applied to the valve operator 48.

According to an important aspect of the invention, when the loading system 18 is operating in a cyclic or automatic mode, the pump 20 may be energized to provide flow through the valve 36 when temperature or pressure controls (which are described below in grater detail) sense either low temperature condition in the supply fluid or a low pressure condition in the accumulator tank 26. It will likewise be appreciated that the loading system 18 can operate in a continuous or manual mode, continuously circulating the fluid through the loading system 18. In describing the invention, the operation of the unloading valve 36, as illustrated in FIGS. 1–4, will be described with reference to its automatic operation, first, when a low pressure condition is sensed, and, second, when a low temperature condition is sensed. The components of the valve 36 are additionally described with reference to FIGS. 5–8; further details of the structure and operation of the valve 36 are disclosed in U.S. Pat. No. 5,156,717, issued Oct. 20, 1992 Finally, the overall operation of the system will be described with reference to the system representation shown in FIG. 11.

As shown in FIG. i, the flow progresses from the inlet 40, through the valve operator 48 and outlet restrictor 47 to the bypass outlet 44. The resulting pressure drop is communicated to the valve spool 49 by lines 52 and 54. The opposite end of the spool 49 communicates with the bypass outlet 49 through lines 56 and 58. In order to provide a flow connection between the lines 52, 54, 56, 58, a directional control valve 62 is provided. In the embodiment exemplified in FIGS. 1–4, a solenoid 63 operated four-way valve 62 is utilized to direct the flow to the ends of the valve operator 48. As shown in FIG. 1, the solenoid 63 operated valve 62 is in its deenergized position, directing pressure from the inlet 40 through the lines 52 and 54 to the upper end of the spool 49, and also connecting an outlet path from the lower end of the spool 49 through the lines 56 and 58 to the bypass outlet 44. In order to prevent impurities in the fluid exiting the pump 20 from interfering with the smooth operation of the directional control valve 62 and the valve operator 48, a filter 64 is interposed in line 52. Line 52 is also provided with a valve 66 that is normally set in the open position. Although the invention is described in terms of pressures at the inlet 40 and the bypass outlet 44 (i.e., a double-acting arrangement), alternate arrangements are contemplated. For example, the pressure created at the inlet 40 could be directed to one end of the valve operator 48, and the opposite end could be connected directly to a drain, such as with a single-acting operator or the like.

Figure 2:
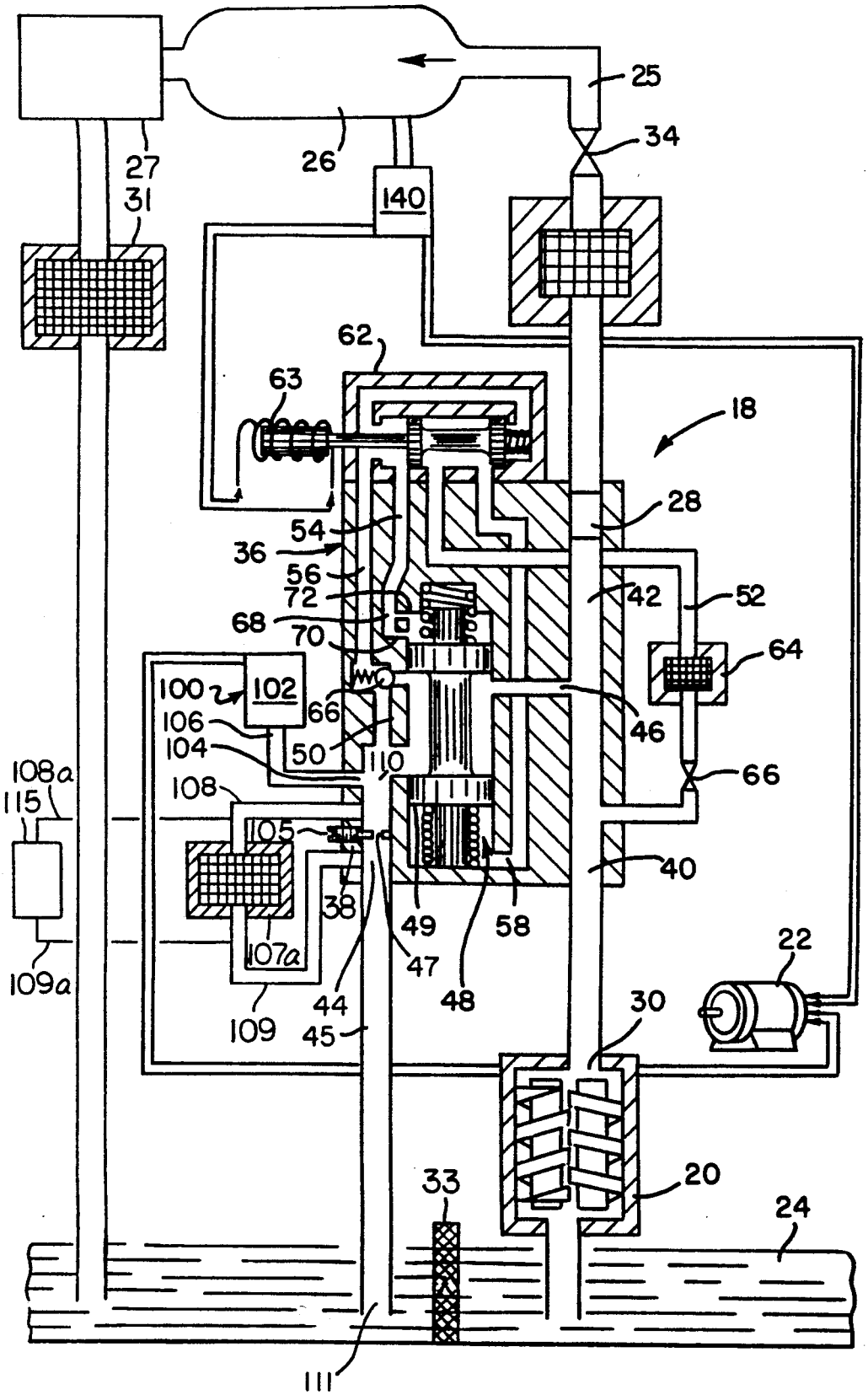
FIG. 2 is the schematic of the system of FIG. 1 in an unloaded position with the directional control valve in the second position.

During operation in the automatic mode, when automatic controls (described below) sense a low pressure condition in the accumulator tank 26, the controls begin the pumping cycle by energizing the motor 22, which rotates the pump 20 to begin pumping fluid from the sump 24 to the unloading valve 36. The electrical solenoid 63 is likewise energized to move the valve 62 to its alternate condition, as shown in FIG. 2. It will be appreciated that circuitry may be provided to energize the solenoid 63 at approximately the same time as power is supplied to the pump 20. In this way, the solenoid 63 operated valve 62 connects the bypass outlet 44 to the upper end of spool 49 by way of lines 56 and 54, and connects the valve inlet 40, and, therefore, the pump outlet 30 to the lower end of the spool 49 by way of lines 52 and 58.

Figure 5:
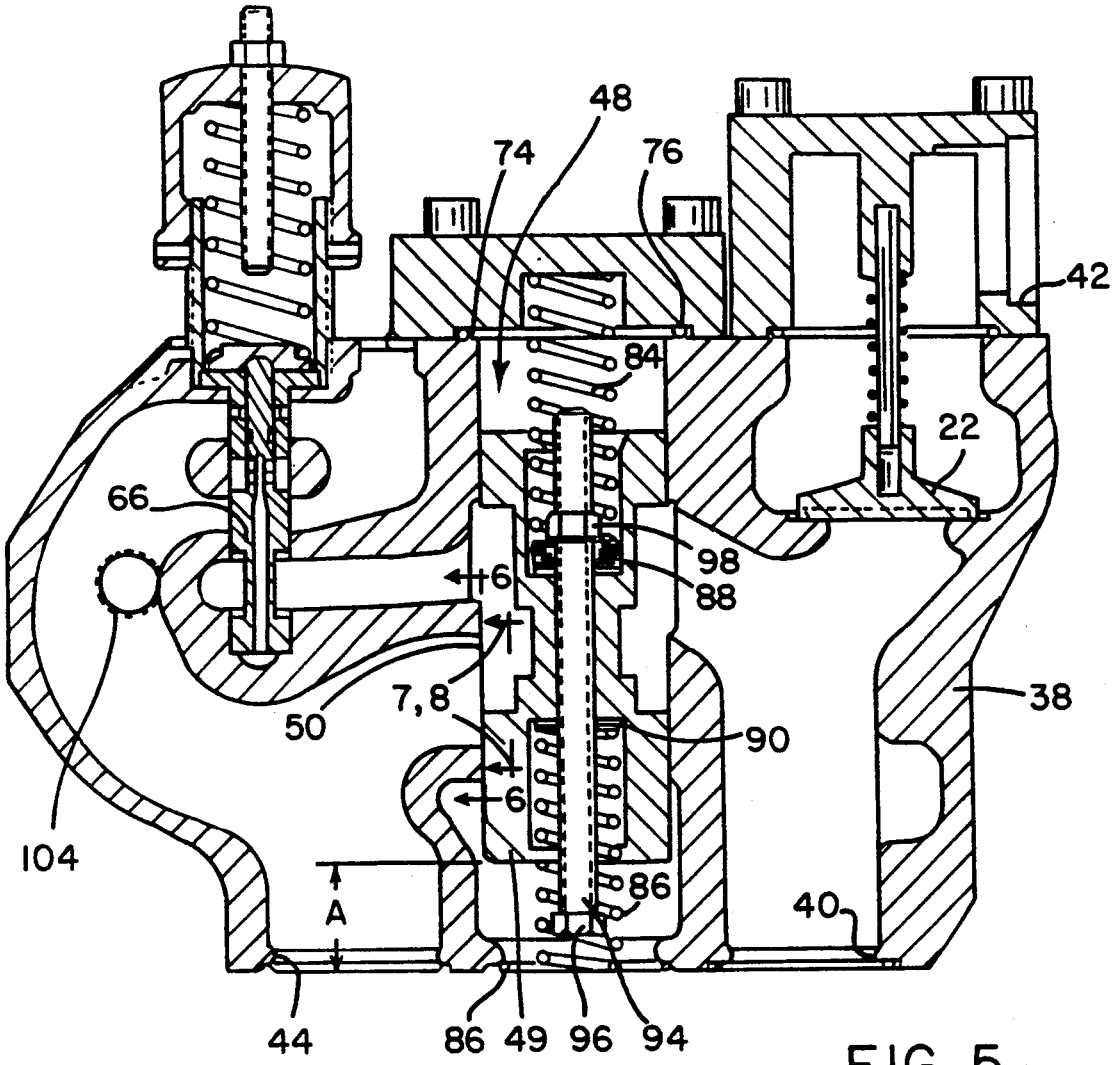
FIG. 5 is a cross-sectional view of the unloading valve of the invention.

It will further be appreciated that while the spool 49 travels through a range of positions during operation, it has three equilibrium positions, as illustrated in FIGS. 1–5. The spool 49 may be stationary when it is in its extreme downward position, as shown in FIGS. 1 and 2, when it is in its extreme upward, loaded position, as shown in FIGS. 3 and 4, or when it is in its "spring-biased" position, as shown in FIG. 5. In the broadest sense, both of the positions shown in FIGS. 1, 2, and 5, wherein the bypass port 50 is at least partially open, may be considered unloaded. When the motor 22 first is energized, the spool 49 will be in a spring-biased quiescent condition (as shown in the cross-sectional view of the valve 36 in FIG. 5), allowing fluid flow to the bypass outlet 44. Alternately, if the pump 20 is running in a continuous mode, the spool 49 will be disposed at a downward position, as shown in FIG. 1, where the solenoid 63 operated directional control valve 62 is in its de-energized position, directing inlet 40 pressure to the top of the spool 49. As a result, a very light load is placed on the pump 20 when it is running in its continuous mode.

If while the pump 20 is running in a continuous and unloaded condition, a signal is given to energize the solenoid 63 of the directional control valve 62, the pressure at the inlet 40 is redirected from the top to the bottom of the spool 49. As a result, the spool 49 begins to rise, closing off the bypass port 50. As the open area of port 50 becomes progressively restrictive, the pressure at the inlet 40 increases, which increases the operating force applied to the valve operator 48. As the spool 49 progresses toward its extreme upward position, sufficient pressure is developed within the valve 36 to begin opening the one-way check valve 28 to provide flow through the working outlet 42. As the port 50 becomes progressively restrictive and eventually fully closes off bypass flow, the one-way check valve 28 fully opens to allow full fluid flow to pass through the working outlet 42 to the load or accumulator 26, as shown in FIG. 3.

When flow to the high pressure load 26 is no longer required, as when normal pressure or a desired minimum is re-established in the accumulator tank, a signal is provided to de-energize the solenoid 63 operated valve 62 to restore it to the position shown in FIG. 4. Returning the directional valve 62 to its original position once again connects the valve inlet 40, and, therefore, the pump outlet 30, to the upper end of the spool 49 by way of lines 52 and 54, and further connects the bypass outlet 44 to the lower end of the spool 49 by way of lines 56 and 58. Consequently, the pressure is applied to the spool 49 ends such that the high pressure fluid from the pump outlet 30 flowing through the valve inlet 40 causes the valve operator 48 to return to the unloaded condition shown in FIG. 1. The resultant flow through the valve 36 to return to the bypass outlet 44, significantly reduces the load on the pump 20. When the piston 48 is in the fully unloaded position, the load on the pump 20 is greatly reduced and the motor 22 can be stopped to shut down the pump 20. Alternately, in a manual or continuous flow system the pump 20 can continue to run substantially unloaded until it is indicated that another cycle is required or until the fluid reaches a desired temperature level, as described below.

A cross-sectional view of the unloading valve 36 is shown in more detail in FIG. 5 wherein the components of the valve 36 correspond to those discussed above with reference to the schematics of FIGS. 1–4. While the lines 52, 54, 56, 58 that apply the pressure or operating force across the valve operator 48 are not illustrated in FIG. 5, those connections would be the same as in the schematics of FIGS. 1 through 4. The spool 49 is shown in a spring-biased quiescent position, as when there is no flow through the loading valve 36, as before the start of a pumping cycle. When the pumping cycle is initiated and as the pump 20 comes up to speed, the spool 49 rises to block the bypass port 50 to prevent flow to the bypass outlet 44. As a result, the fluid flows through the working outlet 42 to the high pressure load 26 (not shown in FIG. 5). When the solenoid 63 operated valve 62 (not shown in FIG. 5) reverses the pressure or operating force across the valve operator 48, the spool 49 moves downward to again allow flow to the bypass outlet 44, which reduces the load on the pump 20 so that the power supply to the pump 20 may be discontinued.

The unloading valve 36 is additionally provided with a relief valve 66 disposed along the outlet side of the valve operator 48. While the relief valve 66 may be set to allow fluid passage at any appropriate pressure, in a preferred embodiment of the invention, the pressure at which the relief valve 66 allows fluid passage may be set in a range between around 200 to 1650 psi. In one unit embodying the invention, the relief valve 66 pressure was preset at 590 psi. The relief valve 66 provides a safety feature by preventing pressure within the valve 36 from exceeding desired operating levels.

Further, to prevent rapid unrestricted movement of the spool 49, flow to and from at least one end of the valve operator 48 is restricted by an orifice assembly 68, as shown in FIGS. 1–4. While it will be appreciated that such assemblies could be provided to restrict the flow to and from either or both the chambers at the upper and lower ends of the valve operator 48, in a preferred embodiment of the invention, an orifice assembly 68 is disposed to control the flow of fluid to and from the upper end of the valve operator 48 as directed by the solenoid 63 operated directional valve 62.

According to a feature of the illustrated unloading valve 36, the unloading valve 36 may be adjusted to accommodate a wide range of flow capacities and pressures, and provide movement of the spool 49 at a desired differential pressure. In short, the same valve 36 can be configured to be fully functional in a small system where design flow rates are only 10 gpm, or in a substantially larger system where flow rates of 400 gpm are accommodated. Likewise, the valve 36 can accommodate a corresponding wide range of pressures. The valve 36 can accommodate pressures ranging from about 150 psi to 1100 psi, or, in some cases, as high as 1650 psi. In accomplishing these features such that a single valve 36 may be configured to operate over a range of pressures and flow rates, no major mechanical changes in the valve body 38 itself as well as changes in various components utilized in the valve 36 are required. Rather, in order to configure a valve 36 that operates over a particular range of flow rates or pressures, the valve 36 has a number of possible initial setups. Inasmuch as this is a substantial flow range for the operation of a device of a single design, it will be appreciated that manufacturing, servicing and stocking of parts of the valve is greatly simplified in that a single valve body 38 and other related components may be utilized in a number of applications.

As explained in greater detail in U.S. Pat. No. 5,156,717, issued Oct. 20, 1992, in order to adapt the valve 36 of the invention for different flow rates, the valve 36 may be set up so that the open area of the port 50 is of the appropriate size to result in spool 49 movement at 50 psi or other desired differential pressure for a given flow rate. In accomplishing this objective, the invention provides a particularly shaped port 50 design as well as means to adjust the extent to which the bypass port 50 will open during maximum flow through the unloading valve 36.

Figure 6:
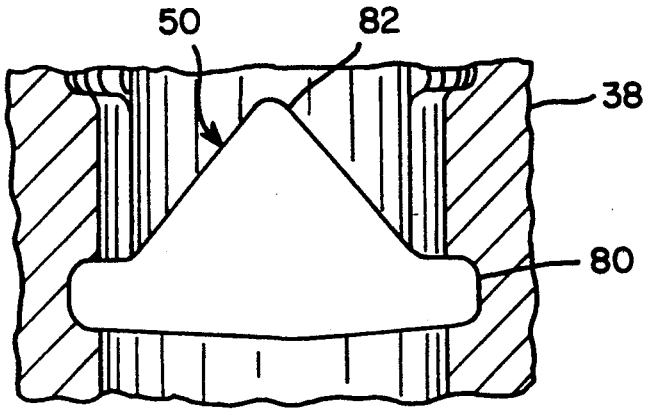
FIG. 6 is fragmentary view of the bypass port taken along line 6—6 in FIG. 5.

Turning first to the design of the bypass port 50, the port 50 has a shape that is particularly suited for passing a range of flows. The bypass port 50, which is shown in FIG. 6 has a large, substantially rectangular-shaped lower portion 80, and a substantially triangular-shaped upper portion 82. It will be appreciated that this particular port 50 shape is given by way of example, and that the port 50 may be of an alternate shape that likewise provides smooth transitional loading and unloading.

The spring-biased position of the spool 49 is determined by a system of centering springs 84, 86 and spacers 88, 90. Thus, in order to vary the area of the bypass port 50 that is open to fluid flow at pump 20 start up, the number of spacers (in this embodiment washers 88, 90 are used) and the spring 84, 86 biased gap A may be adjusted at initial setup of the valve 36.

At low flow rates, the unloader valve operator spool 49 may be set up to close off all of the large rectangular portion 80 of the bypass port 50, as shown in FIG. 7. In this way, the bypass flow is restricted to the triangular portion 82 of the port 50, which will generate the requisite pressure drop across the unloader valve operator 48 at a low flow rate. At higher flow rates, the spool 49 may be set up to allow the opening of a large portion of the rectangular-shaped port 80 as shown in FIG. 8. This allows a higher bypass flow rate to generate the same pressure drop across the valve 36.

A chart of representative flow related settings for the setup of the valve 36 in a preferred embodiment are shown in the chart identified as FIG. 9. It will be appreciated that the values given are by way of representation and not limitation. As shown in the chart, for a given flow rate in gallons per minute (gpm), a specified number of washers 88, 90 may be assembled with the unloader piston to achieve the specified gap identified as A in FIG. 5. Gap A represents the distance between the lower surface of the unloader valve operator spool 49 in its quiescent spring-biased position and a reference point, which is the lower surface of the valve body 38 in this embodiment. As shown in the chart of the FIG. 9, for low flow rate, such as 10–50 gallons per minute, the gap A is relatively large. Consequently, a majority of the large rectangular portion 80 of the bypass port is closed off by the spool 49 such that the flow through the bypass outlet 44 is restricted primarily to the triangular portion 82, as described above and shown in FIG. 7. Returning now to the chart of FIG. 9, it will be appreciated that the gap A is reduced at higher flow rates. This results in a larger opening of the rectangular-shaped portion 80 of the bypass port 50, as shown in FIG. 8 and explained above, allowing a higher bypass flow rate through the bypass outlet 44 for a given pressure drop across the port 50. Thus, valve 36 may be set up to provide a desired differential pressure across the valve 36 for either high or low flow rates, as shown in the chart. Each of the representative flow related setups shown in FIG. 9 will provide a 50 psi differential pressure for the given flow rates.

In accordance with an important aspect of the invention, the valve 36 may used to provide controlled heating of the hydraulic fluid. In order to provide such controlled heating, means are provided whereby the valve 36 permits flow therethrough at a relatively low pressure differential. In a preferred embodiment of the invention, the pressure differential is on the order of approximately 20 psi. In this way, the valve 36 may be adjusted to provide a second differential pressure by adjusting a stop to establish a minimum lower position for the unloader valve operator spool 49 when the valve 36 is operating in an unloaded condition shown in FIG. This stop includes a threaded rod 94, which extends through the spool 49. The lower bolt head 96 on the threaded rod 94 may be rotated to thread the rod 94 through the spool 49 and the upper bolt 98. During operation, the downward movement of the spool 49 will be limited when the lower bolt head 96 and the threaded rod 94 reach the base plate 86 of the valve 36 shown in FIG. 5, and schematically illustrated in FIG. 1. This second differential pressure is especially useful to avoid oil heating problems when the pump 20 is being run continuously, as in the manual mode, for example in flow ranges of 10–400 gallons per minute. In this way, a low but controlled pressure drop may be established across the valve 36 when the pump 20 is running substantially unloaded.

According to accepted principles of fluid dynamics, flow through the valve 36 at this low, second differential pressure will yield a controlled heating of the fluid. The fluid, which is heated as it flows through the unloader valve 36, is returned to the sump 24. To ensure adequate mixing of the fluid to both enhance the heating and filtering processes, the sump 24 may be designed so that the heated fluid supplied from the valve 36 is forced to take a long, and perhaps circuitous, path before reaching the pump 20 suction or inlet. Flow through this long path also provides additional time for gases to escape from the fluid. Further, to reduce undesirable frothing, the fluid may be introduced into the sump 24 below the fluid level.

Figure 10:
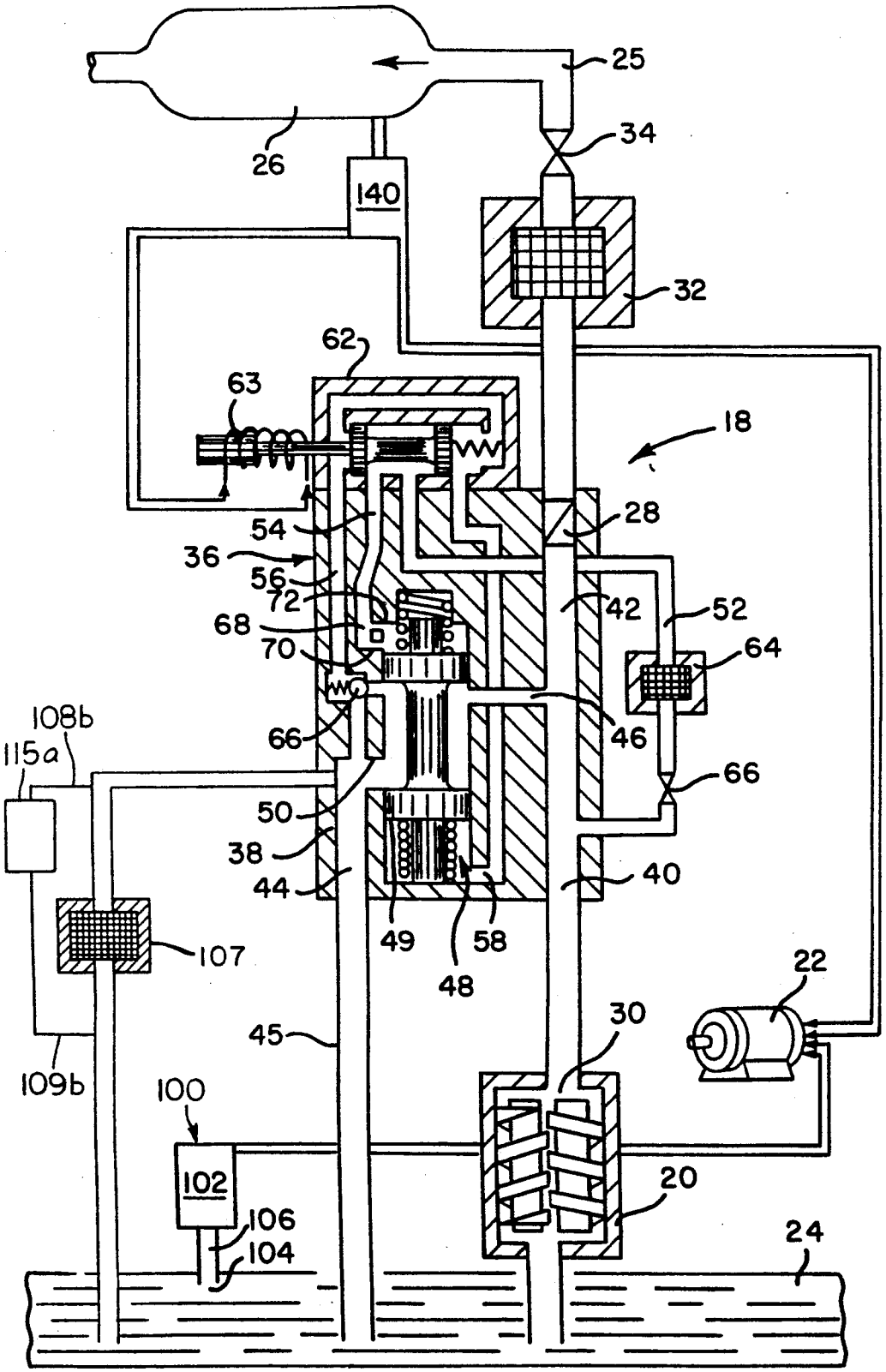
FIG. 10 is a schematic view of an alternate embodiment of the hydraulic fluid supply system.

When the loading system 18 is in an automatic or cyclic mode and the valve 36 is in the unloaded position shown in FIG. 1, the spool 49, which is disposed in the lower-most position permitted by the lower bolt head 96 and rod 94, allows flow through the valve 36 to the bypass outlet 44. In order to monitor the temperature of the fluid, a temperature sensing device 100 is provided. It will be appreciated that the sensing device 100 may be disposed at any appropriate location to monitor the temperature of the fluid in the system 18. In the embodiment shown in FIGS. 1–5, for example, the temperature sensing device 100 is disposed along the bypass side of the valve 36 to monitor the temperature of fluid flowing through the bypass outlet 44. This location is particularly advantageous in that the temperature sensing device 100 may be conveniently provided as an integral part of the unloader valve 36. Alternately, the temperature sensing device 100 could include a pipe with a pipe well that extends down into the sump 24 to provide a direct reading of the temperature of the fluid in the sump 24. (This embodiment is not shown in the figures.) The temperature sensing device 100 may alternately, and perhaps more efficiently be disposed to directly read the temperature of the fluid in the sump 24, as shown in FIG. 10. In this way, the effects on the temperature sensing device 100 due to the temperature of the valve body 38 itself or other components of the system may be minimized.

The temperature sensing device 100 is coupled to the pump 20 such that the power supply to the pump 20 is discontinued when the temperature of the fluid is within a desired temperature range. The temperature sensing device 100 may be of any appropriate design. In a preferred embodiment of the invention, the temperature sensing device 100 is a proximately located temperature switch or a remotely disposed temperature switch 102 having a thermal element, such as a bulb 104 and a capillary 106, that automatically senses a change in temperature and opens or closes an electrical switch when the fluid reaches a predetermined temperature. The temperature switch 102 may incorporate a compensating device to cancel out the adverse effects of ambient fluctuations in the fluid temperature and may be adjustable to allow for changes in the actuation points. In the preferred embodiment of the invention, the temperature sensing device 100 incorporates a single thermal element 104, 106, and two independently adjustable switches 102 that open the electrical contact when the oil reaches a desired high temperature to discontinue power to the pump 20 and close the electrical contact when the oil is at a temperature lower than the desired temperature range. In this way, when the fluid temperature is lower than the temperature required to provide a desirable viscosity level, power will be supplied to the pump 20 so that fluid circulates through the unloading valve 34 to heat the fluid. When the circulating fluid reaches the temperature required to provide the desired viscosity level, power to the pump 20 is discontinued to cease the circulation and the heating of the fluid by flow through the valve 34.

According to another important aspect of the invention, the valve 18 may be provided with a filter (shown as 107 in FIG. 10 and 107*a* in FIGS. 1–4) to provide a desired level of cleanliness to the fluid. The filter 107, 107*a* is disposed along the outlet side of the valve 18 so that at least a portion of the flow developed through the valve 18 by the pump 20 is circulated through the filter 107, 107*a* before returning to the sump 24. The outlet flow through the filter 107 may be channeled directly to the sump 24, as shown in FIG. 10. Alternately, and preferably, the outlet flow through the filter 107*a* may be established through pipe 108 returned to the outlet of the valve 18 via pipe 109, as shown in FIGS. 1–4. Thus, as flow progresses through the valve 18, as may be provided during the heating operation, as explained above, at least a portion of the flow is filtered to remove impurities before returning to the sump 24.

The cleanliness control function of the valve 18 may be explained in greater detail with reference to the embodiment shown in FIGS. 1–4. In this embodiment, the valve 18 preferably includes an outlet orifice or restrictor 47, however, the restrictor 47 is not an essential part of the invention (so long as a back pressure is created at the filter to provide the desired flow through the filter). The restrictor 47 may be of any appropriate design, such as a sharp edged orifice, or a simple direct-acting spring relief valve operative at a single set pressure, e.g., on the order of 20 psi.

It will be appreciated that, in accordance with accepted principles of fluid dynamics, the constant oil flow from the pump 20 develops a pressure drop across the restrictor 47, which is generally of a fixed size during operation of the valve 18. If the restrictor 47 is a sharp-edged orifice, the pressure drop will develop according to the relationship $Q=Ka\sqrt{\Delta P}$, where Q is the fixed pump flow, K is a constant, a is the cross-sectional area of the orifice, and $\Delta P$ is the pressure drop developed across the orifice.

Thus, the restrictor 47 may be sized or be adjusted to provide a desired pressure drop. To provide this adjustment, the valve 18 may be configured with a fixed size restrictor 47 that is designed to give the desired pressure drop, or, alternately, the valve 18 may be provided with a means for adjusting the size of the restrictor, such as the adjustment screw 105 shown in FIGS. 1–4.

Due to the relatively low pressures of the system flow during the heating operation and the filtering arrangement wherein only a portion of the flow is diverted to the filter 107*a*, the filter 107*a* may be of a relatively low cost, low pressure type. For example, an automotive-type spin-on filter may be utilized, provided it has been properly industrialized.

It will further be appreciated that the relative sizes of the components of the valve 18, the filter 107, 107*a*, and the pipes 108, 109 may be chosen to provide desired properties. The design and operation, however, will be explained with reference to an exemplary embodiment.

In a preferred embodiment, full filter flow is on the order of 15 gpm. At this flow rate, it has been determined that the filter system will provide the desired level of cleanliness if the pump is run on a 50% pump duty cycle. The following exemplary pressures for the preferred embodiment are typical of those experienced when the filter utilized is clean. The pressures will vary, however, as the filter becomes blocked due to dirt or debris.

In the exemplary embodiment of the invention shown in FIG. I, the components (i.e., the restrictor 47, the chamber disposed directly before the restrictor 47 (designated generally as 110), and the flow pipe 44, in particular) are sized such that an internal pressure on the order of 20–25 psi is developed in the chamber 110, the fluid at the outlet 44 is approximately 5 psi, and a pressure drop of approximately 15–20 psi is developed across the restrictor 47. Due to pipe losses, the fluid exiting the return line 45 at outlet 111 is at approximately 0 psi. The invention may alternately utilize a relief valve (i.e. as the restrictor 47), as explained above, which is set at approximately 20 psi.

Further, the pipe 108 connecting the valve chamber 110 to the inlet side of the filter 107*a* is very short. Consequently, there is a minimal pipe loss or pressure drop from the valve chamber 110 to the filter 107*a* inlet. Conversely, the return pipe 109, connecting the outlet side of the filter 107*a* to the valve outlet 44, is relatively long, providing a pressure drop on the order of 10 psi with full filter flow. Thus, with a filter flow of 15 gpm, there will be a 10 psi pressure drop across the filter 107*a*. It will be appreciated that, when the filter 107*a* is clean, the fluid returning to the valve outlet 44 from the return pipe 109 will be at essentially the same pressure as the fluid passed through the restrictor 47 —5 psi.

According to another aspect of the invention, the cleanliness of the filter 107*a* itself may be monitored to determine the optimal time for replacement of the filter 107*a*. As the filter 107*a* becomes dirty, it progressively restricts flow therethrough.

Consequently, the pressure drop across the filter 107*a* increases, flow therethrough decreases, and the pressure drop due to pipe losses in pipe 109 decreases. Thus, by monitoring the change in the pressure drop across the filter 107*a*, it may be determined when it is desirable to replace the filter 107*a*. The change in the pressure drop may be monitored by any appropriate means. (shown generally in FIGS. 1–4 as 108*a*, 109*a*, and 115, and in FIG. 10 as 108*b*, 109*b*, and 115*a*) For example, the filter 107*a* may be provided with a pop-up indicator or an indicator with an electrical alarm contact. Such indicators may be set to pop-up or alarm at an appropriate high pressure drop (such as 20 psi) to indicate a low flow condition through the filter 107*a*.

It will thus be appreciated that the cleanliness control method of the invention provides a simple, reliable, effective, and economical method of maintaining a desired level of cleanliness in the system. In the exemplary embodiment explained above, it has been determined that the filter system develops an average of 10 gpm of filtering. Thus, with a 50% pump duty cycle, or around 12 hours per day, the system filters 7200 gallons per day, a volume generally adequate to provide desired cleanliness in many hydraulic systems, while optimizing oil viscosity. It will further be appreciated that the filter 107*a* may be externally piped to the valve 18 by means of piping 108, 109, or integrated into the valve 18 itself.

Figure 11:
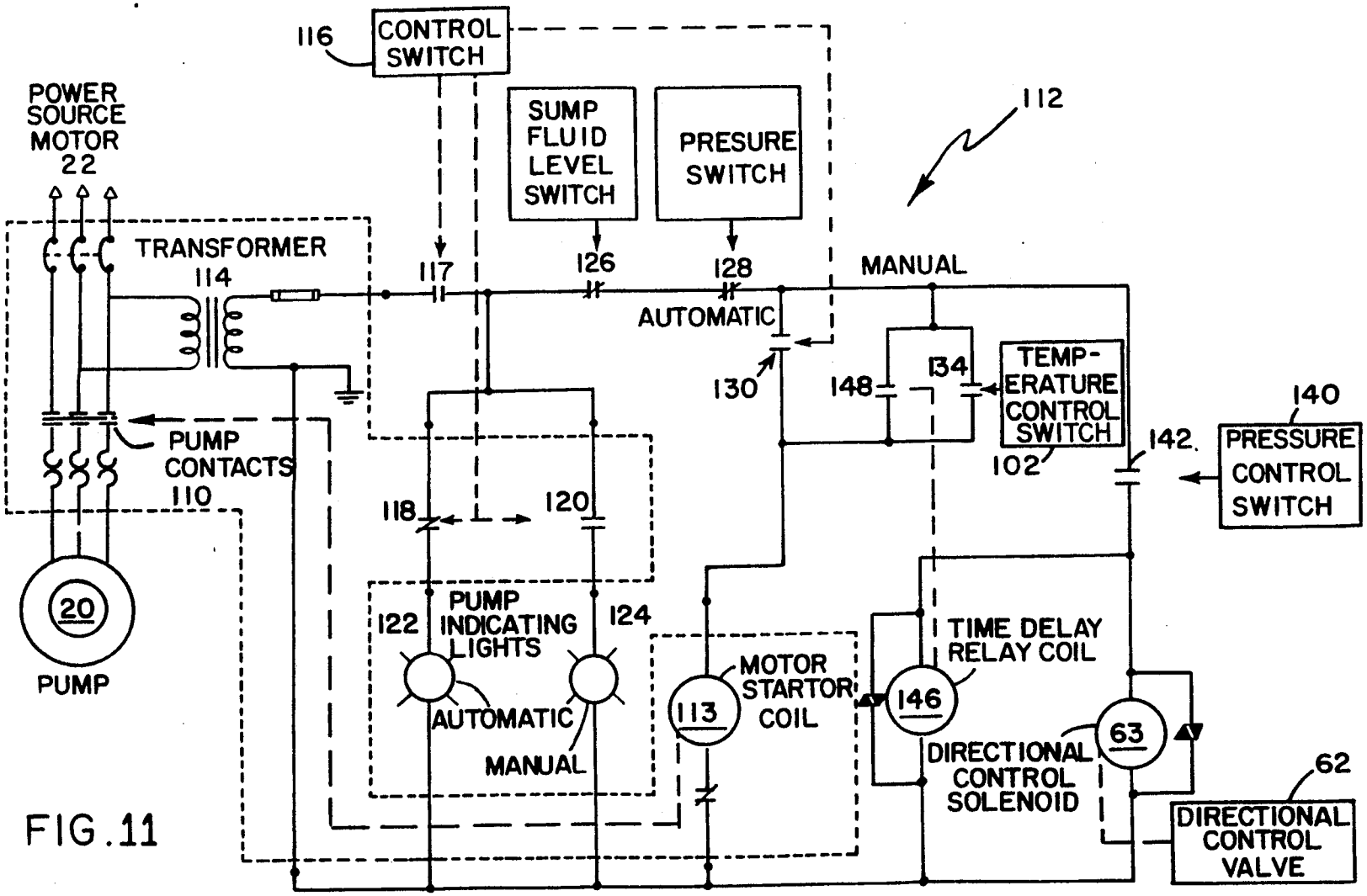
FIG. 11 is a representation of the electrical control system of the hydraulic fluid supply system.

Overall operation of the system 18, and the temperature and viscosity level control system in particular, may be described with reference to the electrical control system shown in FIG. 11. A motor 22 provides operating power to the pump 20 through electrical contacts 110 when the contacts 110 are in the closed position. The power source 22 likewise supplies power to the control system, which is generally designated as 112. It will be appreciated by those skilled in the art that when appropriate control contacts are closed and the motor starter coil 113 is energized, electrical contacts 110 will be closed to supply power to the pump 20.

A transformer 114 may be disposed between the power source 22 and the control system 112 to provide an isolated control voltage supply, if so desired. In a preferred embodiment of the invention, a voltage of 480 volts from a three-phase, sixty Hz motor 22 is dropped to 115 volts to power the control system 112. The system 112 is provided with a control switch 116, which operates contact 117, having "OFF," "AUTOMATIC," and "MANUAL" modes. When the switch 116 is in the "AUTOMATIC" mode, the system 18 will run in the cyclic mode. When the switch 116 is in the "MANUAL" mode, the system 18 will run continuously. Thus, when the control switch 116 is in the "OFF" position, contact 117 will be in the open position. Conversely, contact 117 will be in the closed position when the control switch 116 designates the "AUTOMATIC" or "MANUAL" modes. Auxiliary contacts 118, 120 may be provided to supply power to pump indicating lights 122, 124, which indicate whether the pump 20 is operating in the "AUTOMATIC" or "MANUAL" mode.

The control system 112 may likewise provide safety contacts to prevent conditions that would potentially result in a malfunction of the supply system 18. For example, the system 112 may include a normally closed contact 126 that opens to discontinue the supply of power to the pump 20 when the fluid level in the sump 24 falls below a desired level, or a normally closed pressure switch 128 that opens to likewise discontinue the supply of power to the motor 20 when the system 18 reaches the pressure at which the pressure switch 128 is set to operate. Any suitable pressure-sensing element may be utilized in the pressure switch 128. For example, bourdon tube type elements, sealed piston type elements, and diaseal piston type elements may be particularly appropriate because of their operating ranges.

During operation, when the control switch 116 is in the "MANUAL" mode, contacts 117 and 130 will be closed. As a result, the motor starter coil 113 will be energized, contacts 110 closed, and the pump 20 will run continuously, as explained above. Alternately, if the control switch 116 is in the "AUTOMATIC" mode, the motor starter coil 113 may be energized, and, therefore, the contacts 110 closed in order to supply power to the motor 20, if the temperature of the fluid falls below a desired level, or the pressure in the accumulator 26 drops below a desired level, as explained above.

Turning first to the temperature control system, a temperature switch 102 is disposed in the unloading system 18 to automatically sense a change in the temperature of the hydraulic fluid. When the temperature falls below a desired level, the temperature switch 102 closes contact 134 to energize the motor starter coil 113, close contacts 110 and supply power to the motor 20. Conversely, when the temperature exceeds a desired level, the temperature switch 102 opens contact 134 to de-energize the motor starter coil 113, open contacts 110, and discontinue the supply of power to the motor 20.

Power may likewise be supplied to the pump 20 when a pressure switch 140 senses a low pressure condition in the accumulator 26. A indicated with respect to pressure safety contact 128, the pressure switch 140 may utilize any appropriate pressure-sensing element. Again, bourdon tube type sensing elements, sealed piston type sensing elements, and dia-seal piston type sensing elements may be particularly suited for this application because of the ranges of pressures at which they operate. When the pressure switch 140 senses a low pressure condition, it closes pressure contact 142, and when the desired pressure is restored, the switch 140 opens contact 142.

When the pressure contact 142 is closed, solenoid 63 operated directional control valve 62 is energized to transfer the valve 62 to its second position, illustrated in FIG. 2. Further, time delay relay coil 146 (which includes a delay on de-enerization) is energized to close contact 148 and immediately energize the motor starter coil 113, to close contacts 110, and supply power to the pump 20. As a result, the unloading valve 36 will move to a loaded condition and the accumulator 26 will ultimately be supplied with high pressure fluid, as explained above in detail with respect to FIGS. 1–3.

When the pressure switch 140 senses that the accumulator 26 has been restored to a desired pressure level, it opens the pressure contact 142 to deenergize the solenoid 63 and return the directional control valve 62 to its original position, as shown in FIG. 4. The unloading valve 36 subsequently returns to its unloaded condition. In order to allow the unloading valve 36 to fully return to the unloaded condition, shown in FIG. 1, before contacts 110 are opened and the power supply to the motor 20 interrupted, the time delay relay coil 140 continues to hold the contact 148 closed so that power to the motor 20 is not immediately discontinued. In this Way, operation of the time delay relay coil 140 prevents undesirable shock to the hydraulic loading system 18 in that the unloading valve 36 has sufficient time to return to the unloaded condition before power to the pump 20 is discontinued. In a preferred embodiment of the invention, this delay time, though adjustable from 0.5 to 15 seconds, is set to allow the pump 20 to continue to operate for a few seconds after pressure contact 142 opens so that optimum performance of the system may be obtained.

In summary, the invention provides a system for and a method of establishing and maintaining fluid at desired cleanliness, viscosity, and temperature levels in a hydraulic fluid system. The system includes a driven pump 20 that circulates fluid from a fluid supply 24 through a hydraulic loading system 18 that includes an unloading valve 36. As fluid flows through the valve 36, a pressure drop is created across the valve operator 48 and/or the outlet restrictor 47. As a result, the temperature of the fluid flowing through the valve 36 to the sump 24 increases, thus increasing the temperature of the fluid in the sump 24. During operation of the system 18, if a low temperature condition is sensed in the system 18, power will be supplied to the pump 20, which will pump fluid through the valve 36 at a controlled low pressure drop to result in a controlled heating of the fluid. When the fluid is restored to a desired temperature level, power to the pump 20 is interrupted to terminate flow through the valve 36. The level of heat produced in the fluid may be adjusted by adjusting the degree that the pressure drops as the fluid flows through the valve 36. This is accomplished by adjusting the degree of the restriction to flow across the valve operator 48 and/or across the outlet restrictor. Thus, the unloader valve 36 is utilized as an efficient and economical means of controlling the temperature of the fluid in the system, as well as ensuring proper cleanliness levels.

I claim as my invention:

1. A method of controlling the cleanliness of hydraulic fluid in a closed hydraulic system having a sump containing hydraulic fluid, a pump, a bypass valve having a valve operator for controlling the flow direction between a low pressure bypass path and a high pressure load path, comprising the steps of:

supplying power to the pump, pumping high pressure fluid from the sump through the valve along the load path to a load, advancing the valve operator to redirect flow through the valve to the bypass path, pumping low pressure fluid from the sump through the valve along the bypass path and returning the fluid to the sump, coupling a portion of flow through the valve along the bypass path to a filter assembly, pumping a portion of the low pressure fluid flowing through the valve along the bypass path through the filter assembly, whereby the filter assembly can be constructed to handle only moderate pressures and flow rates, and returning the fluid to the sump.

2. The method as claimed in claim 1 further comprising the step of restricting flow through the valve along the bypass path by imposing a restriction to create a controlled pressure differential across the restriction.

3. The method as claimed in claim 2 wherein the coupling step comprises the step of coupling flow along the bypass path upstream the restriction to the filter assembly, and the step of pumping a portion of the fluid flowing through the filter assembly includes the steps of pumping fluid flowing along the bypass path upstream the restriction through the filter assembly, and returning the fluid flowing through the filter assembly to the sump downstream the restriction.

4. The method as claimed in claim 3 wherein the returning the fluid flowing through the filter assembly to the sump includes returning the fluid to the bypass path downstream the restriction.

5. The method as claimed in claim 2 further comprising the step of adjusting the restriction to adjust the pressure differential across the restriction.

6. The method as claimed in claim 1 wherein the returning step includes returning the fluid pumped through the filter assembly directly to the sump.

7. The method as claimed in claim i further comprising the step of measuring a pressure drop across the filter as a measurement of the cleanliness of the filter.

8. The method as claimed in claim 7 further comprising the steps of comparing the measured pressure drop with a predetermined pressure for a dirty filter and replacing the filter when the measured pressure drop exceeds the predetermined pressure.

9. A flow system for connection to a supply of power, the flow system utilizing an unloading valve to control viscosity and fluid cleanliness, comprising:

a fluid supply, a pump which pumps fluid from the fluid supply when supplied with power, the valve having an inlet connected to the pump, a working outlet connected to a load, and a bypass outlet connected to the fluid supply, the valve having a loaded position defining a working flowpath wherein the bypass outlet is closed and the valve supplies fluid flow to the load through the working outlet, and an unloaded position defining a bypass flowpath wherein the bypass outlet is substantially open and the valve supplies fluid flow to the bypass outlet, a filter assembly, means for coupling at least a portion of flow along the bypass flowpath to the filter assembly to filter fluid to remove impurities, means for returning filtered fluid to the fluid supply, a temperature sensor disposed to determine the temperature of the fluid, means for comparing the sensed temperature to a predetermined temperature range, and means for coupling the temperature sensor to the pump to discontinue power to the pump when the temperature of the fluid reaches a temperature within the predetermined range.

10. The flow system as claimed in claim 9 wherein the means for returning filtered fluid to the fluid supply comprises a pipe which returns fluid directly to the fluid supply.

11. The flow system as claimed in claim 9 wherein the valve further comprises a restriction to flow along the bypass path which creates a pressure differential across the valve.

12. The flow system as claimed in claim 11 wherein the means for coupling couples flow along the bypass path upstream the restriction to the filter assembly, and the returning means returns filtered fluid to the fluid supply returns filtered fluid to the sump downstream the restriction.

13. The flow system as claimed in claim 12 wherein the returning means returns filtered fluid to the valve downstream the restrictor.

14. The flow system as claimed in claim 11 wherein the restrictor is disposed in the bypass outlet of the valve.

15. The flow system as claimed in claim 12 wherein the coupling means comprises a relatively short pipe with low pipe losses, and the returning means comprises a relatively long pipe.

16. The flow system as claimed in claim 12 wherein a filter system pressure drop is created across the coupling means, the filter, and the returning means, and the filter system pressure drop is substantially equal to the pressure differential across the restrictor.

17. The flow system as claimed in claim 16, further comprising means for measuring the filter system pressure drop as a measurement of the cleanliness of the filter.

18. A flow system as claimed in claim 9, wherein the bypass valve is an unloader valve.

19. A flow system utilizing a bypass valve to control fluid cleanliness, comprising:

a fluid supply, a pump which pumps fluid from the fluid supply, the bypass valve having an inlet connected to the pump, a working outlet connected to a high pressure load, and a bypass outlet connected to the fluid supply, the bypass valve having a loaded position in which fluid flow from the pump is directed to the high pressure load, and a bypass position in which fluid from the pump is directed to a lower pressure high flow rate bypass path for return to the sump, a filter, means for coupling the filter in the bypass path for receiving a portion only of the bypass flow to filter said portion and define a filtering path, the filtering path having a low working pressure about equivalent to the pressure in the bypass path and a flow rate lower than the full bypass flow rate, whereby the filter can be constructed to handle only moderate pressures and flow rates, while operating in a high pressure system, the flow system having at least three operating conditions including:

an off state in which the pump is inactive, a loaded state in which the bypass valve, after switching to the loaded position, directs fluid flow to the high pressure load, and a filter state in which the bypass valve is maintained in the bypass condition for circulating and filtering the fluid.

20. The flow system as claimed in claim 19 wherein the bypass path comprises means for returning filtered fluid to the fluid supply including a pipe which returns fluid directly to the fluid supply.

21. The flow system as claimed in claim 19 wherein the bypass valve further comprises a restriction to flow along the bypass path which creates a pressure differential across the restriction.

22. The flow system as claimed in claim 21 wherein the means for coupling couples flow along the bypass path upstream the restriction to the filter, and the filtered fluid returns to the fluid supply downstream the restriction.

23. The flow system as claimed in claim 21 wherein the coupling means returns filtered fluid to the valve downstream the restrictor.

24. The flow system as claimed in claim 22 wherein the coupling means comprises a relatively short pipe with low pipe losses upstream the restriction, and a relatively long pipe downstream the restriction.

25. The flow system as claimed in claim 22 wherein a filter system pressure drop is created across the coupling means and the filter and the filter system pressure drop is substantially equal to the pressure differential across the restriction.

26. The flow system as claimed in claim 25 further comprising means for measuring the filter system pressure drop as a measurement of the cleanliness of the filter.

* * * * *

UNITED STATES PATENT AND TRADEMARK OFFICE

CERTIFICATE OF CORRECTION

PATENT NO. : 5,215,444

DATED : June 1, 1993

INVENTOR(S) : DAVID R. BISHOFF

It is certified that error appears in the above-identified patent and that said Letters Patent is hereby corrected as shown below:

Column 1, line 3, insert "FIELD OF THE INVENTION" and delete from line 10;

Column 5, line 45, delete "an" and substitute therefor -- and --;

Column 7, line 6, after "interval" insert ".";

Column 7, line 30, after "FIGS." delete "i" and substitute therefor -- 1 --;

Column 7, line 48, after "FIGS." delete "I" and substitute therefor -- 1 --;

Column 8, line 50, after "valve" insert ".";

Column 9, line 6, after "FIGS." delete "i" and substitute therefor -- 1 --;

Column 9, line 13, after "FIGS." delete "I" and substitute therefor -- 1 --;

Column 9, line 45, after "1992" insert ".";

Column 9, line 48, after "FIG." delete "i" and substitute therefor -- 1 --;

UNITED STATES PATENT AND TRADEMARK OFFICE

CERTIFICATE OF CORRECTION

PATENT NO. : 5,215,444

DATED : June 1, 1993

INVENTOR(S) : DAVID R. BISHOFF

It is certified that error appears in the above-identified patent and that said Letters Patent is hereby corrected as shown below:

Column 13, line 34, after "FIG." insert "1";

Column 15, line 55, after "FIG." delete "I" and substitute therefor -- 1 --;

Column 16, lines 17-30, starting with "Consequently," should not be a new paragraph;

Column 17, line 49, delete "A" and substitute therefor -- As --; and

Column 18, line 15, delete "Way" and substitute therefor -- way --.

Signed and Sealed this

Fifteenth Day of March, 1994

Bruce Lehman

*Attest:*

BRUCE LEHMAN

*Attesting Officer*

*Commissioner of Patents and Trademarks*